US009258656B2

(12) United States Patent
Ruppersberg et al.

(10) Patent No.: US 9,258,656 B2
(45) Date of Patent: Feb. 9, 2016

(54) SOUND ACQUISITION AND ANALYSIS SYSTEMS, DEVICES AND COMPONENTS FOR MAGNETIC HEARING AIDS

(71) Applicant: Sophono, Inc., Boulder, CO (US)

(72) Inventors: Peter Ruppersberg, Blonay (CH); Markus C Haller, Nyon (CH); Todd C Wyant, Louisville, CO (US); Nicholas F Pergola, Arvada, CO (US)

(73) Assignee: SOPHONO, INC., Boulder, CO (US)

( * ) Notice: Subject to any disclaimer, the term of this patent is extended or adjusted under 35 U.S.C. 154(b) by 0 days.

(21) Appl. No.: 14/288,181

(22) Filed: May 27, 2014

(65) Prior Publication Data

US 2014/0275736 A1 Sep. 18, 2014

Related U.S. Application Data

(63) Continuation-in-part of application No. 13/550,581, filed on Jul. 16, 2012, now abandoned, and a continuation-in-part of application No. 13/650,026, filed on Oct. 11, 2012, and a continuation-in-part of (Continued)

(51) Int. Cl.
*H04R 25/00* (2006.01)
*H04R 3/00* (2006.01)

(52) U.S. Cl.
CPC ..... *H04R 25/606* (2013.01); *H04R 3/002* (2013.01); *H04R 25/608* (2013.01); *H04R 25/70* (2013.01); *H04R 2460/13* (2013.01)

(58) Field of Classification Search
None
See application file for complete search history.

(56) References Cited

U.S. PATENT DOCUMENTS

| | | | |
|---|---|---|---|
| 4,352,960 | A | 10/1982 | Dormer et al. |
| 4,612,915 | A | 9/1986 | Hough et al. |
| 4,726,378 | A | 2/1988 | Kaplan |
| 4,736,747 | A | 4/1988 | Drake |
| RE32,947 | E | 6/1989 | Dormer |
| 4,918,745 | A | 4/1990 | Hutchinson |
| 5,558,618 | A | 9/1996 | Maniglia |

(Continued)

FOREIGN PATENT DOCUMENTS

| | | |
|---|---|---|
| WO | 2010/105601 | 9/2010 |
| WO | 2015/020753 A2 | 2/2015 |
| WO | 2015/034582 A2 | 3/2015 |

OTHER PUBLICATIONS

"A Miniature Bone Vibrator for Hearing Aids and Similar Applications," BHM-Tech Produktionsgesellschaft m.b.H, Austria, 2004, Technical Data VKH3391W.

(Continued)

*Primary Examiner* — Curtis Kuntz
*Assistant Examiner* — Qin Zhu
(74) *Attorney, Agent, or Firm* — Jeffrey J. Hohenshell

(57) ABSTRACT

Disclosed are various embodiments of components and devices in a sound acquisition system for a magnetic hearing aid that include a sound acquisition device. In one embodiment, the sound acquisition device is configured to be positioned between a magnetic spacer and a magnetic implant, and to be magnetically coupled to the magnetic spacer and the magnetic implant, such that sound signals generated by an EM transducer in the hearing aid may be acquired by a sound sensor forming a portion of the sound acquisition device as the sound signals pass through the sound acquisition device into the patient's skull or a test fixture.

37 Claims, 11 Drawing Sheets

Related U.S. Application Data application No. 13/650,057, filed on Oct. 11, 2012, now Pat. No. 9,022,917, and a continuation-in-part of application No. 13/650,080, filed on Oct. 11, 2012, now Pat. No. 9,210,521, and a continuation-in-part of application No. 13/649,934, filed on Oct. 11, 2012, and a continuation-in-part of application No. 13/804,420, filed on Mar. 14, 2013, now Pat. No. 9,031,274, and a continuation-in-part of application No. 13/793,218, filed on Mar. 11, 2013.

(60) Provisional application No. 61/970,336, filed on Mar. 25, 2014.

(56) References Cited

U.S. PATENT DOCUMENTS

| | | | | |
|---|---|---|---|---|
| 5,906,635 | A | 5/1999 | Maniglia | |
| 6,246,911 | B1 | 6/2001 | Seligman | |
| 6,358,281 | B1 | 3/2002 | Berrang et al. | |
| 6,517,476 | B1 | 2/2003 | Bedoya et al. | |
| 6,537,200 | B2 | 3/2003 | Leysieffer et al. | |
| 6,565,503 | B2 | 5/2003 | Leysieffer et al. | |
| 6,648,914 | B2 | 11/2003 | Berrang et al. | |
| 6,754,358 | B1 * | 6/2004 | Boesen et al. | 381/326 |
| 7,021,676 | B2 | 4/2006 | Westerkull | |
| 7,065,223 | B2 | 6/2006 | Westerkull | |
| 7,186,211 | B2 | 3/2007 | Schneider et al. | |
| 7,386,143 | B2 | 6/2008 | Easter et al. | |
| 7,599,508 | B1 | 10/2009 | Lynch et al. | |
| 7,856,986 | B2 | 12/2010 | Darley | |
| 8,107,661 | B1 | 1/2012 | Lynch et al. | |
| 8,170,253 | B1 | 5/2012 | Lynch et al. | |
| 8,255,058 | B2 | 8/2012 | Gibson et al. | |
| 8,270,647 | B2 | 9/2012 | Crawford et al. | |
| 8,315,705 | B2 | 11/2012 | Keuninckx | |
| 8,369,959 | B2 | 2/2013 | Meskens | |
| 8,406,443 | B2 | 3/2013 | Westerkull et al. | |
| 8,452,412 | B2 | 5/2013 | Ibrahim | |
| 8,509,461 | B2 * | 8/2013 | Parker | 381/150 |
| 8,515,112 | B2 | 8/2013 | Crawford et al. | |
| 8,538,545 | B2 | 9/2013 | Meskens | |
| 8,774,930 | B2 | 7/2014 | Ball | |
| 8,787,608 | B2 | 7/2014 | Van Himbeeck et al. | |
| 8,811,643 | B2 | 8/2014 | Crawford et al. | |
| 8,837,760 | B2 * | 9/2014 | Andersson et al. | 381/326 |
| 8,891,795 | B2 | 11/2014 | Andersson | |
| 8,897,475 | B2 | 11/2014 | Ball et al. | |
| 8,897,883 | B2 | 11/2014 | Griffith | |
| 8,923,968 | B2 | 12/2014 | Meskens | |
| 8,934,984 | B2 | 1/2015 | Meskens et al. | |
| 9,020,174 | B2 | 4/2015 | Asnes | |
| 2002/0019669 | A1 * | 2/2002 | Berrang et al. | 623/10 |
| 2003/0163287 | A1 * | 8/2003 | Vock et al. | 702/187 |
| 2004/0181117 | A1 * | 9/2004 | Adams et al. | 600/25 |
| 2005/0222487 | A1 * | 10/2005 | Miller et al. | 600/25 |
| 2007/0041595 | A1 * | 2/2007 | Carazo et al. | 381/151 |
| 2007/0053536 | A1 | 3/2007 | Westerkull | |
| 2007/0057601 | A1 * | 3/2007 | Kawase et al. | 310/328 |
| 2007/0135862 | A1 * | 6/2007 | Nicolai et al. | 607/56 |
| 2007/0274551 | A1 | 11/2007 | Tsai et al. | |
| 2009/0043149 | A1 * | 2/2009 | Abel | 600/25 |
| 2009/0060245 | A1 * | 3/2009 | Blanchard et al. | 381/345 |
| 2009/0097681 | A1 * | 4/2009 | Puria et al. | 381/318 |
| 2009/0138062 | A1 * | 5/2009 | Balslev | 607/55 |
| 2009/0180631 | A1 * | 7/2009 | Michael et al. | 381/58 |
| 2009/0248155 | A1 | 10/2009 | Parker | |
| 2009/0299437 | A1 | 12/2009 | Zimmerling | |
| 2010/0145135 | A1 * | 6/2010 | Ball et al. | 600/25 |
| 2010/0179375 | A1 * | 7/2010 | Andersson et al. | 600/25 |
| 2010/0290652 | A1 * | 11/2010 | Wiggins et al. | 381/314 |
| 2010/0298626 | A1 * | 11/2010 | Andersson et al. | 600/25 |
| 2011/0022120 | A1 | 1/2011 | Ball et al. | |
| 2011/0125063 | A1 * | 5/2011 | Shalon et al. | 600/590 |
| 2011/0158443 | A1 * | 6/2011 | Åsnes et al. | 381/326 |
| 2011/0164772 | A1 * | 7/2011 | Nishizaki et al. | 381/314 |
| 2011/0216927 | A1 * | 9/2011 | Ball | 381/313 |
| 2011/0243357 | A1 * | 10/2011 | Probst et al. | 381/328 |
| 2011/0249839 | A1 * | 10/2011 | Mindlin et al. | 381/314 |
| 2011/0319703 | A1 * | 12/2011 | Wiskerke et al. | 600/25 |
| 2012/0029267 | A1 * | 2/2012 | Ball | 600/25 |
| 2012/0041515 | A1 | 2/2012 | Meskens et al. | |
| 2012/0051569 | A1 * | 3/2012 | Blamey et al. | 381/314 |
| 2012/0078035 | A1 | 3/2012 | Andersson et al. | |
| 2012/0080039 | A1 | 4/2012 | Siegert | |
| 2012/0088957 | A1 | 4/2012 | Adamson et al. | |
| 2012/0165597 | A1 * | 6/2012 | Proulx et al. | 600/25 |
| 2012/0183165 | A1 * | 7/2012 | Foo et al. | 381/314 |
| 2012/0238799 | A1 | 9/2012 | Ball et al. | |
| 2012/0294466 | A1 | 11/2012 | Kristo et al. | |
| 2012/0296155 | A1 | 11/2012 | Ball | |
| 2012/0300951 | A1 * | 11/2012 | Voix et al. | 381/56 |
| 2012/0302822 | A1 * | 11/2012 | Van Himbeeck et al. | 600/25 |
| 2012/0302823 | A1 | 11/2012 | Andersson et al. | |
| 2012/0303097 | A1 * | 11/2012 | Bernhard et al. | 607/57 |
| 2013/0004000 | A1 * | 1/2013 | Franck | 381/314 |
| 2013/0018218 | A1 | 1/2013 | Haller et al. | |
| 2013/0046131 | A1 | 2/2013 | Ball et al. | |
| 2013/0150657 | A1 | 6/2013 | Leigh et al. | |
| 2013/0177189 | A1 * | 7/2013 | Bryant et al. | 381/315 |
| 2013/0261377 | A1 * | 10/2013 | Adamson et al. | 600/25 |
| 2013/0266165 | A1 * | 10/2013 | Neumeyer | 381/314 |
| 2013/0281764 | A1 | 10/2013 | Bjorn et al. | |
| 2014/0064531 | A1 | 3/2014 | Andersson et al. | |
| 2014/0121447 | A1 | 5/2014 | Kasic et al. | |
| 2014/0121449 | A1 | 5/2014 | Kasic et al. | |
| 2014/0121450 | A1 | 5/2014 | Kasic et al. | |
| 2014/0121451 | A1 | 5/2014 | Kasic et al. | |
| 2014/0121452 | A1 | 5/2014 | Kasic et al. | |
| 2014/0126731 | A1 * | 5/2014 | Litvak et al. | 381/60 |
| 2014/0153737 | A1 * | 6/2014 | Geschiere et al. | 381/74 |
| 2014/0163692 | A1 | 6/2014 | Van den Heuvel et al. | |
| 2014/0193011 | A1 * | 7/2014 | Parker | 381/326 |
| 2014/0205122 | A1 * | 7/2014 | Stoffels et al. | 381/328 |
| 2014/0233765 | A1 * | 8/2014 | Andersson et al. | 381/151 |
| 2014/0270293 | A1 | 9/2014 | Ruppersberg et al. | |
| 2014/0275731 | A1 * | 9/2014 | Andersson et al. | 600/25 |
| 2014/0275735 | A1 | 9/2014 | Ruppersberg et al. | |
| 2014/0275736 | A1 | 9/2014 | Ruppersberg et al. | |
| 2014/0296620 | A1 * | 10/2014 | Puria et al. | 600/25 |
| 2014/0309549 | A1 * | 10/2014 | Selig et al. | 600/559 |
| 2014/0336447 | A1 | 11/2014 | Bjorn et al. | |
| 2015/0016649 | A1 | 1/2015 | Van Himbeeck et al. | |
| 2015/0023534 | A1 * | 1/2015 | Shennib | 381/314 |
| 2015/0038775 | A1 | 2/2015 | Ruppersberg | |
| 2015/0043766 | A1 | 2/2015 | Westerkull | |
| 2015/0063616 | A1 | 3/2015 | Westerkull | |
| 2015/0141740 | A1 | 5/2015 | Miller | |
| 2015/0146902 | A1 | 5/2015 | Jinton et al. | |
| 2015/0156594 | A1 | 6/2015 | Bervoets | |

OTHER PUBLICATIONS

"Microphone 8010T", Data Sheet, RoHS, Sonion, Dec. 20, 2007.
"Inspiria Extreme Digital DSP System," Preliminary Data Sheet, Sound Design Technologies, Mar. 2009.

* cited by examiner

AUDIANT
(PRIOR ART)

BAHA
(PRIOR ART)

ALPHA 1
(PRIOR ART)

260
250
250b
250a
270
233
235b
300
239
235a
237
257
D
+
−
251b
280
251a
207
205
203
209

SOUND ACQUISITION AND ANALYSIS SYSTEMS, DEVICES AND COMPONENTS FOR MAGNETIC HEARING AIDS

RELATED APPLICATIONS

This application is a continuation-in-part of, and claims priority and other benefits from each of the following U.S. patent applications: (a) U.S. patent application Ser. No. 13/550,581 entitled "Systems, Devices, Components and Methods for Bone Conduction Hearing Aids" to Pergola et al. filed Jul. 16, 2012 (hereafter "the '581 patent application"); (b) U.S. patent application Ser. No. 13/650,026 entitled "Magnetic Abutment Systems, Devices, Components and Methods for Bone Conduction Hearing Aids" to Kasic et al. filed on Oct. 11, 2012 (hereafter "the '650 patent application"); (c) U.S. patent application Ser. No. 13/650,057 entitled "Magnetic Spacer Systems, Devices, Components and Methods for Bone Conduction Hearing Aids" to Kasic et al. filed on Oct. 11, 2012 (hereafter "the '057 patent application"); (d) U.S. patent application Ser. No. 13/650,080 entitled "Abutment Attachment Systems, Mechanisms, Devices, Components and Methods for Bone Conduction Hearing Aids" to Kasic et al. filed on Oct. 11, 2012 (hereafter "the '080 patent application"), (e) U.S. patent application Ser. No. 13/649,934 entitled "Adjustable Magnetic Systems, Devices, Components and Methods for Bone Conduction Hearing Aids" to Kasic et al. filed on Oct. 11, 2012 (hereafter "the '934 patent application"); (f) U.S. patent application Ser. No. 13/804,420 entitled "Adhesive Bone Conduction Hearing Device" to Kasic et al. filed on Mar. 13, 2013 (hereafter "the '420 patent application"), and (g) U.S. patent application Ser. No. 13/793,218 entitled "Cover for Magnetic Implant in a Bone Conduction Hearing Aid System, and Corresponding Devices, Components and Methods" to Kasic et al. filed on Mar. 11, 2013 (hereafter "the '218 patent application"). This application also claims priority and other benefits from U.S. Provisional Patent Application Ser. No. 61/970,336 entitled "Systems, Devices, Components and Methods for Magnetic Bone Conduction Hearing Aids" to Ruppersberg et al. filed on Mar. 25, 2014. Each of the foregoing patent applications is hereby incorporated by reference herein, each in its respective entirety.

This application further incorporates by reference herein, each in its respective entirety, the following U.S. Patent Applications filed on even date herewith: (a) U.S. patent application Ser. No. 14/288,142 entitled ""Implantable Sound Transmission Device for Magnetic Hearing Aid, And Corresponding Systems, Devices and Components"" to Ruppersberg et al. (hereafter "the 121 patent application"), and (b) U.S. patent application Ser. No. 14/288,100 entitled "Systems, Devices, Components and Methods for Providing Acoustic Isolation Between Microphones and Transducers in Magnetic Hearing Aids" to Ruppersberg et al. (hereafter "the '120 patent application").

FIELD OF THE INVENTION

Various embodiments of the invention described herein relate to the field of systems, devices, components, and methods for bone conduction and other types of hearing aid devices.

BACKGROUND

A magnetic bone conduction hearing aid is held in position on a patient's head by means of magnetic attraction that occurs between magnetic members included in the hearing aid and in a magnetic implant that has been implanted beneath the patient's skin and affixed to the patient's skull. Acoustic signals originating from an electromagnetic transducer located in the external hearing aid are transmitted through the patient's skin to bone in the vicinity of the underlying magnetic implant, and thence through the bone to the patient's cochlea. In some patients, it may be difficult to ascertain or determine how best to adjust the hearing aids' performance or functional characteristics, or positioning on the patient's skull, to optimize hearing in the patient. Patient feedback can be valuable in such a process of optimization, but may also be ambiguous, uncertain or misleading.

What is needed is a magnetic hearing aid system that somehow provides an improved ability to monitor or determine what the patient is actually hearing, or what the characteristics of the sound signals being generated by the hearing aid actually are.

SUMMARY

In one embodiment, there is provided a sound acquisition system for a magnetic hearing aid comprising an electromagnetic ("EM") transducer disposed in a housing, a magnetic spacer operably coupled to the EM transducer and comprising at least a first magnetic member, the EM transducer, the housing and magnetic spacer forming external portions of the magnetic hearing aid, a magnetic implant configured for placement beneath a patient's skin and adjacent to or in a patient's skull, the magnetic implant comprising at least a second magnetic member, the magnetic spacer and magnetic implant together being configured such that the first and second magnetic members are capable of holding the magnetic hearing aid in position on the patient's skull over at least portions of the implanted magnetic implant, and a sound acquisition device configured to be positioned between the magnetic spacer and the magnetic implant, and to be magnetically coupled to the magnetic spacer and the magnetic implant, such that sound signals generated by the EM transducer in the hearing aid may be acquired by a sound sensor forming a portion of the sound acquisition device as the sound signals pass through the sound acquisition device into the patient's skull.

In another embodiment, there is provided a sound acquisition device configured for use in a sound measurement system for a magnetic hearing aid, the system comprising an electromagnetic ("EM") transducer disposed in a housing, a magnetic spacer operably coupled to the EM transducer and comprising at least a first magnetic member, the EM transducer, the housing and magnetic spacer forming external portions of the magnetic hearing aid, and a magnetic implant configured for placement beneath a patient's skin and adjacent to or in a patient's skull, the magnetic implant comprising at least a second magnetic member, the magnetic spacer and magnetic implant together being configured such that the first and second magnetic members are capable of holding the magnetic hearing aid in position on the patient's skull over at least portions of the implanted magnetic implant, the sound acquisition device being configured to be positioned between the magnetic spacer and the magnetic implant, and to be magnetically coupled to the magnetic spacer and the magnetic implant, such that sound signals generated by the EM transducer in the hearing aid may be acquired by a sound sensor forming a portion of the sound acquisition device as the sound signals pass through the sound acquisition device into the patient's skull.

In still another embodiment, there is provided a method of acquiring sound signals generated by an external magnetic hearing aid configured to be coupled to a magnetic implant, the magnetic hearing aid comprising an electromagnetic ("EM") transducer disposed in a housing and a magnetic spacer operably coupled to the EM transducer and comprising at least a first magnetic member, the magnetic implant being configured for placement beneath a patient's skin and adjacent to or in the patient's skull, the magnetic implant comprising at least a second magnetic member, the magnetic spacer and magnetic implant together being configured such that the first and second magnetic members are capable of holding the magnetic hearing aid in position on the patient's skull over at least portions of the magnetic implant when the magnetic implant is implanted in the patient and the magnetic hearing aid is placed thereover, the sound acquisition device being configured to be positioned between the magnetic spacer and the magnetic implant, and to be magnetically coupled to the magnetic spacer and the magnetic implant, such that sound signals generated by the EM transducer in the hearing aid may be acquired by a sound sensor forming a portion of the sound acquisition device as the sound signals pass through the sound acquisition device into the patient's skull, the method comprising acquiring the sound signals sensed by the sound sensor, processing the acquired sound signals, and analyzing the sound signals.

Further embodiments are disclosed herein or will become apparent to those skilled in the art after having read and understood the specification and drawings hereof.

BRIEF DESCRIPTION OF THE DRAWINGS

Different aspects of the various embodiments will become apparent from the following specification, drawings and claims in which:

FIG. 2(*b*) shows one embodiment of a prior art wiring diagram for a SOPHONO ALPHA 1 hearing aid manufactured using an SA3286 DSP;

FIG. 3(*b*) shows one embodiment of a prior art SOPHONO® ALPHA 1® hearing aid 10;

FIG. 3(*c*) shows another embodiment of a prior art SOPHONO® ALPHA® hearing aid 10;

The drawings are not necessarily to scale. Like numbers refer to like parts or steps throughout the drawings.

DETAILED DESCRIPTIONS OF SOME EMBODIMENTS

Described herein are various embodiments of systems, devices, components and methods for bone conduction and/or bone-anchored hearing aids.

A bone-anchored hearing device (or "BAHD") is an auditory prosthetic device based on bone conduction having a portion or portions thereof which are surgically implanted. A BAHD uses the bones of the skull as pathways for sound to travel to a patient's inner ear. For people with conductive hearing loss, a BAHD bypasses the external auditory canal and middle ear, and stimulates the still-functioning cochlea via an implanted metal post. For patients with unilateral hearing loss, a BAHD uses the skull to conduct the sound from the deaf side to the side with the functioning cochlea. In most BAHA systems, a titanium post or plate is surgically embedded into the skull with a small abutment extending through and exposed outside the patient's skin. A BAHD sound processor attaches to the abutment and transmits sound vibrations through the external abutment to the implant. The implant vibrates the skull and inner ear, which stimulates the nerve fibers of the inner ear, allowing hearing. A BAHD device can also be connected to an FM system or iPod by means of attaching a miniaturized FM receiver or Bluetooth connection thereto.

BAHD devices manufactured by COCHLEAR™ of Sydney, Australia, and OTICON™ of Smoerum, Denmark. SOPHONO™ of Boulder, Colo. manufactures an Alpha 1 magnetic hearing aid device, which attaches by magnetic means behind a patient's ear to the patient's skull by coupling to a magnetic or magnetized bone plate (or "magnetic implant") implanted in the patient's skull beneath the skin.

Surgical procedures for implanting such posts or plates are relatively straightforward, and are well known to those skilled in the art. See, for example, "Alpha I (S) & Alpha I (M) Physician Manual—REV A S0300-00" published by Sophono, Inc. of Boulder, Colo., the entirety of which is hereby incorporated by reference herein.

Figure 1C:
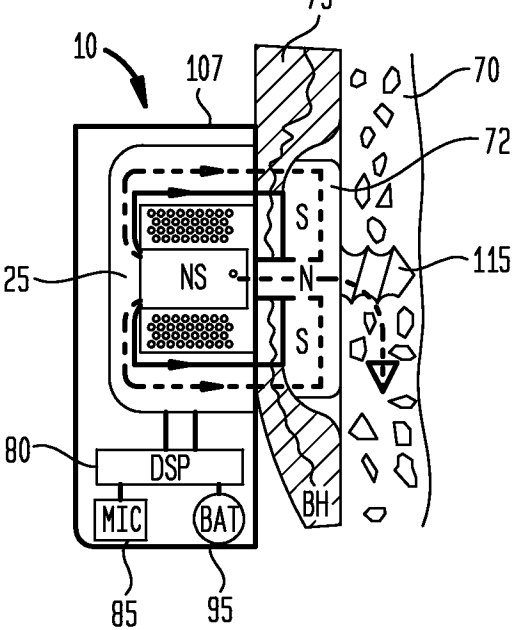
FIGS. 1(*a*), 1(*b*) and 1(*c*) show side cross-sectional schematic views of selected embodiments of prior art SOPHONO ALPHA 1, BAHA and AUDIANT bone conduction hearing aids, respectively.
Figure 1B:
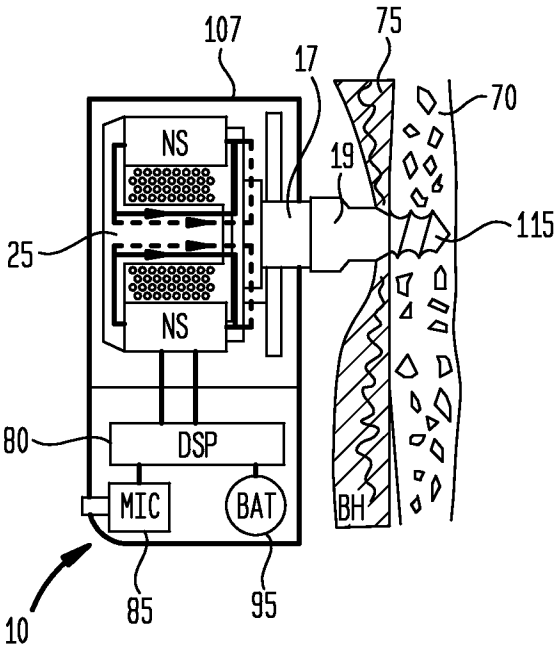
Figure 1A:
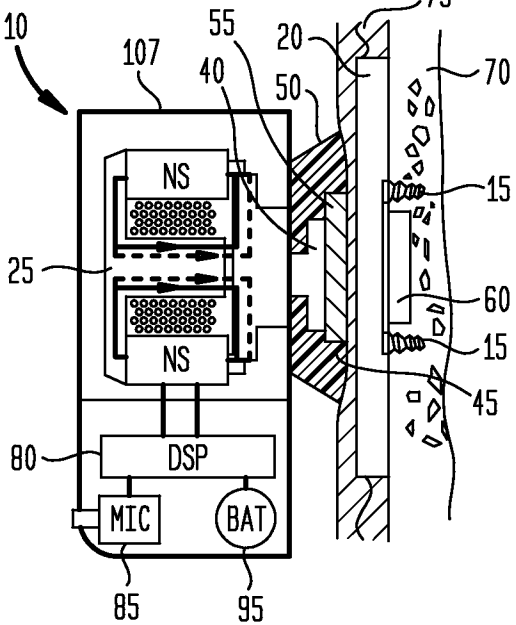

FIGS. 1(*a*), 1(*b*) and 1(*c*) show side cross-sectional schematic views of selected embodiments of prior art SOPHONO® ALPHA 1™, BAHA® and AUDIANT® bone conduction hearing aids, respectively;

In FIG. 1(*a*), magnetic hearing aid device 10 comprises housing 107, electromagnetic/bone conduction ("EM") transducer 25 with corresponding magnets and coils, digital signal processor ("DSP") 80, battery 95, magnetic spacer 50, magnetic implant or magnetic implant bone plate 20. As shown in FIGS. 1(*a*) and 2(*a*), and according to one embodiment, magnetic implant 20 comprises a frame 21 (see FIG. 3(*a*)) formed of a biocompatible metal such as medical grade titanium that is configured to have disposed therein or have attached thereto implantable magnets or magnetic members 60.

Figure 3C:
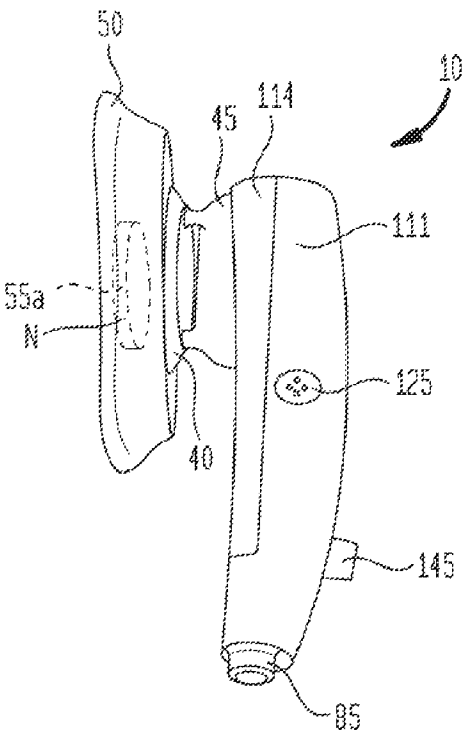
FIG. 3(c) (PRIOR ART)
FIG. 3(*a*) shows one embodiment of prior art magnetic implant 20 according to FIG. 1(*a*)
Figure 3B:
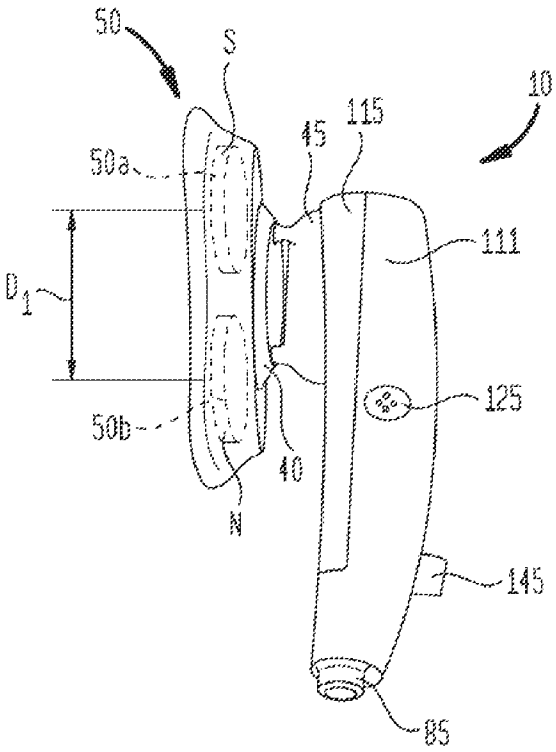
FIG. 3(b) (PRIOR ART)
Figure 3A:
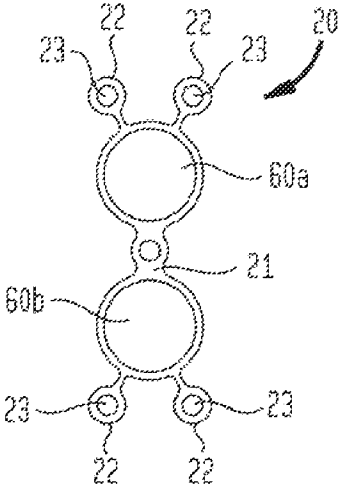
FIG. 3(a) (PRIOR ART)

Bone screws 15 secure or affix magnetic implant 20 to skull 70, and are disposed through screw holes 23 positioned at the outward ends of arms 22 of magnetic implant frame 21 (see FIG. 3(*a*)).

Magnetic members 60*a* and 60*b* are configured to couple magnetically to one or more corresponding external magnetic members or magnets 55 mounted onto or into, or otherwise forming a portion of, magnetic spacer 50, which in turn is operably coupled to EM transducer 25 and metal disc 40. DSP 80 is configured to drive EM transducer 25, metal disk 40 and magnetic spacer 50 in accordance with external audio signals picked up by microphone 85. DSP 80 and EM transducer 25 are powered by battery 95, which according to one embodiment may be a zinc-air battery, or may be any other suitable type of primary or secondary (i.e., rechargeable) electrochemical cell such as an alkaline or lithium battery.

As further shown in FIG. 1(*a*), magnetic implant 20 is attached to patient's skull 70, and is separated from magnetic spacer 50 by patient's skin 75. Hearing aid device 10 of FIG. 1(*a*) is thereby operably coupled magnetically and mechanically to plate 20 implanted in patient's skull 70, which permits the transmission of audio signals originating in DSP 80 and EM transducer 25 to the patient's inner ear via skull 70.

FIG. 1(*b*) shows another embodiment of hearing aid 10, which is a BAHA® device comprising housing 107, EM transducer 25 with corresponding magnets and coils, DSP 80, battery 95, external post 17, internal bone anchor 115, and abutment member 19. In one embodiment, and as shown in FIG. 1(*b*), internal bone anchor 115 includes a bone screw formed of a biocompatible metal such as titanium that is configured to have disposed thereon or have attached thereto abutment member 19, which in turn may be configured to mate mechanically or magnetically with external post 17, which in turn is operably coupled to EM transducer 25. DSP 80 is configured to drive EM transducer 25 and external post 17 in accordance with external audio signals picked up by microphone 85. DSP 80 and EM transducer 25 are powered by battery 95, which according to one embodiment is a zinc-air battery (or any other suitable battery or electrochemical cell as described above). As shown in FIG. 1(*b*), implantable bone anchor 115 is attached to patient's skull 70, and is also attached to external post 17 through abutment member 19, either mechanically or by magnetic means.

Hearing aid device 10 of FIG. 1(*b*) is thus coupled magnetically and/or mechanically to bone anchor 115 implanted in patient's skull 70, thereby permitting the transmission of audio signals originating in DSP 80 and EM transducer 25 to the patient's inner ear via skull 70.

FIG. 1(*c*) shows another embodiment of hearing aid 10, which is an AUDIANT®-type device, where an implantable magnetic member 72 is attached by means of bone anchor 115 to patient's skull 70. Internal bone anchor 115 includes a bone screw formed of a biocompatible metal such as titanium, and has disposed thereon or attached thereto implantable magnetic member 72, which couples magnetically through patient's skin 75 to EM transducer 25. DSP 80 is configured to drive EM transducer 25 in accordance with external audio signals picked up by microphone 85. Hearing aid device 10 of FIG. 1(*c*) is thus coupled magnetically to bone anchor 115 implanted in patient's skull 70, thereby permitting the transmission of audio signals originating in DSP 80 and EM transducer 25 to the patient's inner ear via skull 70.

Figure 2A:
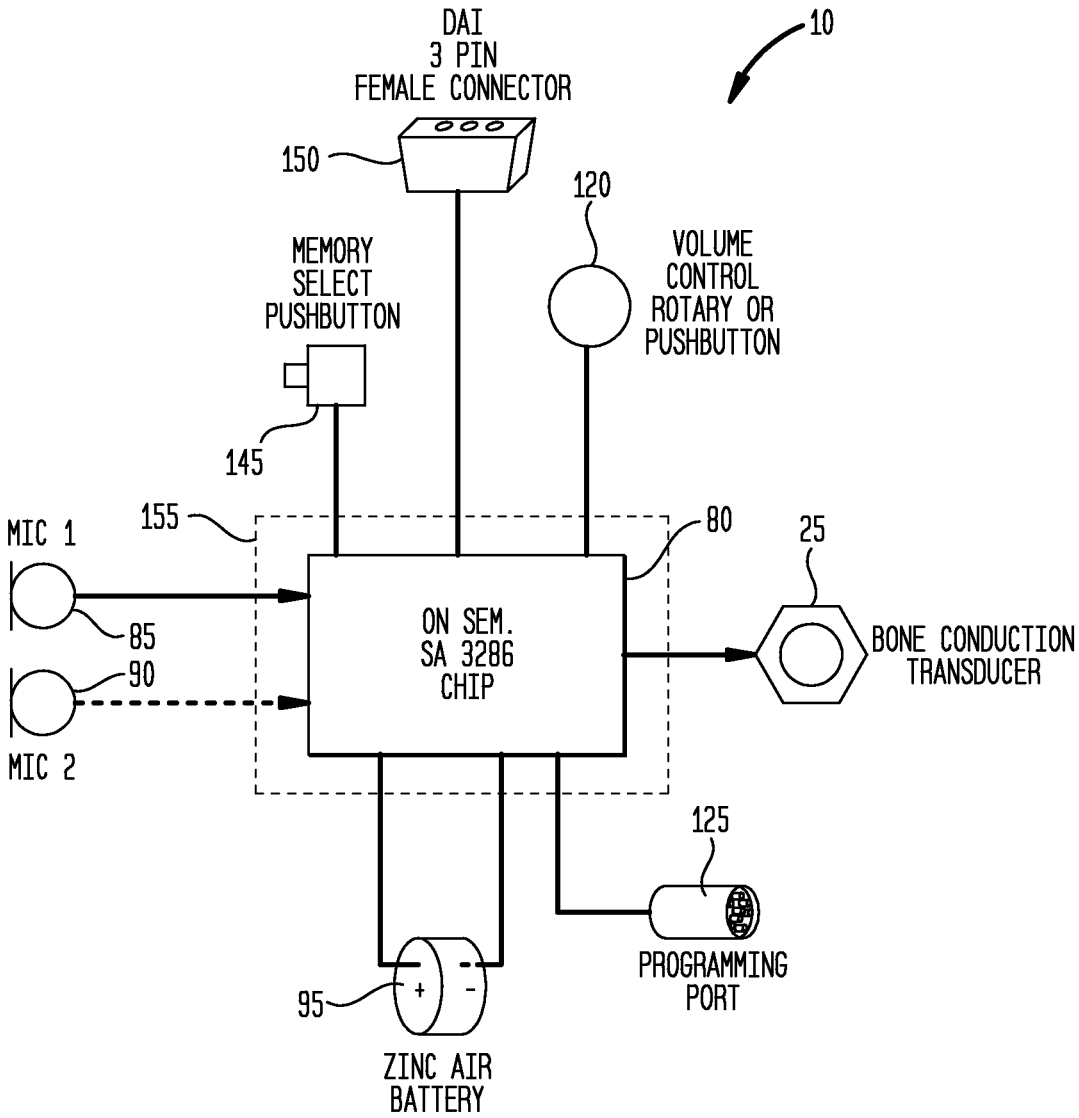
FIG. 2(a) (PRIOR ART)
FIG. 2(*a*) shows one embodiment of a prior art functional electronic and electrical block diagram of hearing aid 10 shown in FIGS. 1(*a*) and 3(*b*)
Figure 2B:
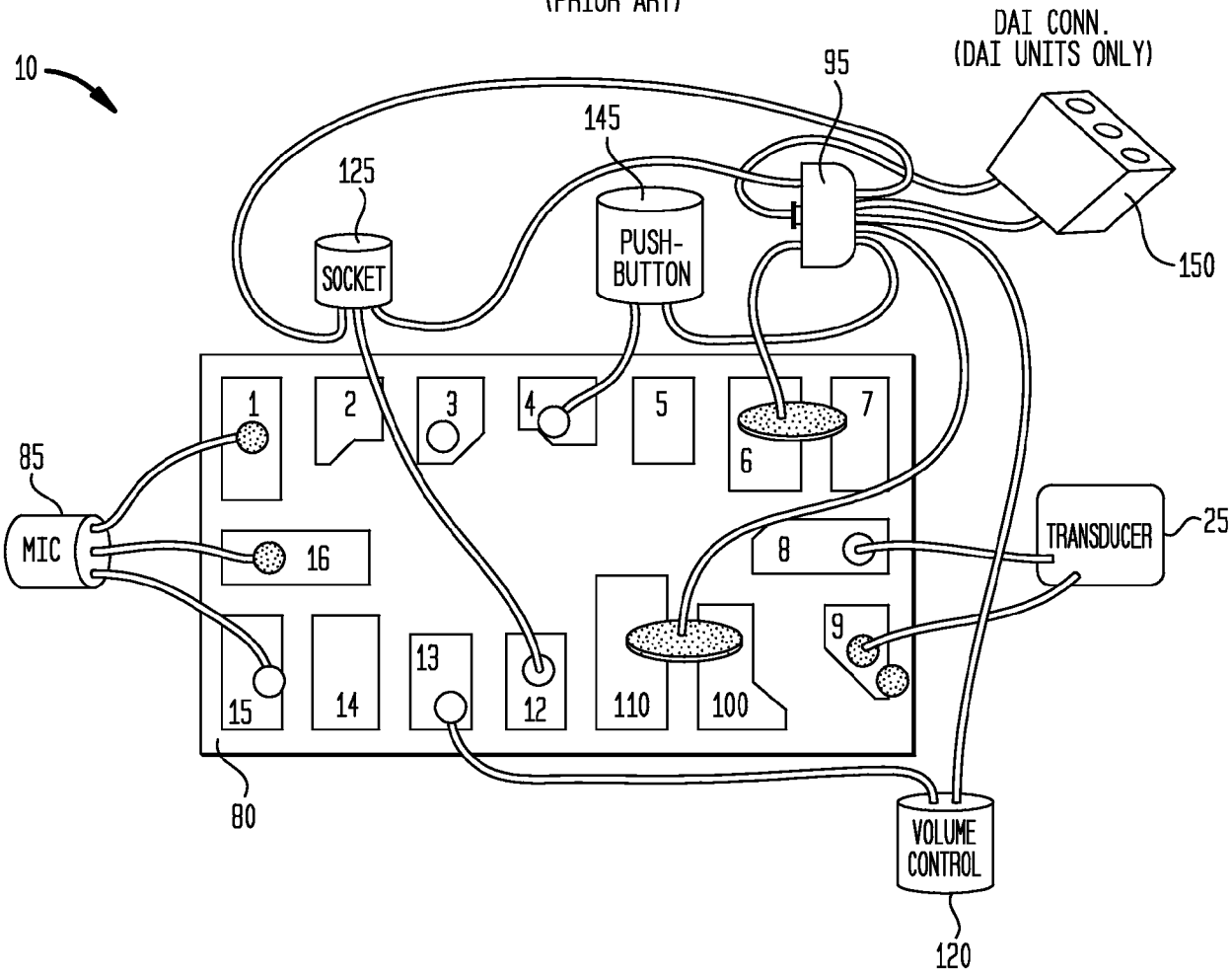
FIG. 2(b) (PRIOR ART)

FIG. 2(*a*) shows one embodiment of a prior art functional electronic and electrical block diagram of hearing aid 10 shown in FIGS. 1(*a*) and 2(*b*). In the block diagram of FIG. 2(*a*), and according to one embodiment, DSP 80 is a SOUND DESIGN TECHNOLOGIES® SA3286 INSPIRA EXTREME® DIGITAL DSP, for which data sheet 48550-2 dated March 2009, filed on even date herewith in an accompanying Information Disclosure Statement ("IDS"), is hereby incorporated by reference herein in its entirety. The audio processor for the SOPHONO ALPHA 1 hearing aid is centered around DSP chip 80, which provides programmable signal processing. The signal processing may be customized by computer software which communicates with the Alpha through programming port 125. According to one embodiment, the system is powered by a standard zinc air battery 95 (i.e. hearing aid battery), although other types of batteries may be employed. The SOPHONO ALPHA 1 hearing aid detects acoustic signals using a miniature microphone 85. A second microphone 90 may also be employed, as shown in FIG. 2(*a*). The SA 3286 chip supports directional audio processing with second microphone 90 to enable directional processing. Direct Audio Input (DAI) connector 150 allows connection of accessories which provide an audio signal in addition to or in lieu of the microphone signal. The most common usage of the DAI connector is FM systems. The FM receiver may be plugged into DAI connector 150. Such an FM transmitter can be worn, for example, by a teacher in a classroom to ensure the teacher is heard clearly by a student wearing hearing aid 10. Other DAI accessories include an adapter for a music player, a telecoil, or a Bluetooth phone accessory. According to one embodiment, DSP 80 or SA 3286 has 4 available program memories, allowing a hearing health professional to customize each of 4 programs for different listening situations. The Memory Select Pushbutton 145 allows the user to choose from the activated memories. This might include special frequency adjustments for noisy situations, or a program which is Directional, or a program which uses the DAI input.

FIG. 2(*b*) shows one embodiment of a prior art wiring diagram for a SOPHONO ALPHA 1 hearing aid manufactured using the foregoing SA3286 DSP. Note that the various embodiments of hearing aid 10 are not limited to the use of a SA3286 DSP, and that any other suitable CPU, processor, controller or computing device may be used. According to one embodiment, DSP 80 is mounted on a printed circuit board 155 disposed within housing 107 of hearing aid 10.

In some embodiments, the microphone incorporated into hearing aid 10 is an 8010T microphone manufactured by SONION®, for which data sheet 3800-3016007, Version 1 dated December, 2007, filed on even date herewith in the accompanying IDS, is hereby incorporated by reference herein in its entirety. Other suitable types of microphones, including other types of capacitive microphones, may be employed.

In still further embodiments, the electromagnetic transducer 25 incorporated into hearing aid 10 is a VKH3391W transducer manufactured by BMH-Tech® of Austria, for which the data sheet filed on even date herewith in the accompanying IDS is hereby incorporated by reference herein in its entirety. Other types of suitable EM or other types of transducers may also be used.

FIGS. 3(*a*), 3(*b*) and 3(*c*) show implantable bone plate or magnetic implant 20 in accordance with FIG. 1(*a*), where frame 22 has disposed thereon or therein magnetic members 60*a* and 60*b*, and where magnetic spacer 50 of hearing aid 10 has magnetic members 55*a* and 55*b* spacer disposed therein. The two magnets 60*a* and 60*b* of magnetic implant 20 of FIG. 2(*a*) permit hearing aid 10 and magnetic spacer 50 to be placed in a single position on patient's skull 70, with respective opposing north and south poles of magnetic members 55*a*, 60*a*, 55*b* and 60*b* appropriately aligned with respect to one another to permit a sufficient degree of magnetic coupling to be achieved between magnetic spacer 50 and magnetic implant 20 (see FIG. 3(*b*)). As shown in FIG. 1(*a*), magnetic implant 20 is preferably configured to be affixed to skull 70 under patient's skin 75. In one aspect, affixation of magnetic implant 20 to skull 75 is by direct means, such as by screws 15. Other means of attachment known to those skilled in the art are also contemplated, however, such as glue, epoxy, and sutures.

Referring now to FIG. 3(*b*), there is shown a SOPHONO® ALPHA 1® hearing aid 10 configured to operate in accordance with magnetic implant 20 of FIG. 3(*a*). As shown, hearing aid 10 of FIG. 3(*b*) comprises upper housing 111, lower housing 115, magnetic spacer 50, external magnets 55*a* and 55*b* disposed within spacer 50, EM transducer diaphragm 45, metal disk 40 connecting EM transducer 25 to spacer 50, programming port/socket 125, program switch 145, and microphone 85. Not shown in FIG. 3(*b*) are other aspects of the embodiment of hearing aid 10, such as volume control 120, battery compartment 130, battery door 135, battery contacts 140, direct audio input (DAI) 150, and hearing aid circuit board 155 upon which various components are mounted, such as DSP 80.

Continuing to refer to FIGS. 3(*a*) and 3(*b*), frame 22 of magnetic implant 20 holds a pair of magnets 60*a* and 60*b* that correspond to magnets 55*a* and 55*b* included in spacer 50 shown in FIG. 3(*b*). The south (S) pole and north (N) poles of magnets 55*a* and 55*b*, are respectively configured in spacer 50 such that the south pole of magnet 55*a* is intended to overlie and magnetically couple to the north pole of magnet 60*a*, and such that the north pole of magnet 55*b* is intended to overlie and magnetically couple to the south pole of magnet 60*b*. This arrangement and configuration of magnets 55*a*, 55*b*, 60*a* and 60*b* is intended permit the magnetic forces required to hold hearing aid 10 onto a patient's head to be spread out or dispersed over a relatively wide surface area of the patient's hair and/or skin 75, and thereby prevent irritation of soreness that might otherwise occur if such magnetic forces were spread out over a smaller or more narrow surface area. In the embodiment shown in FIG. 3(*a*), frame 22 and magnetic implant 20 are configured for affixation to patient's skull 70 by means of screws 15, which are placed through screw recesses or holes 23. FIG. 3(*c*) shows an embodiment of hearing aid 10 configured to operate in conjunction with a single magnet 60 disposed in magnetic implant 20 per FIG. 1(*a*).

Referring now to FIGS. 4 through 9, there are shown various embodiments and views of sound acquisition device 300.

Figure 4:
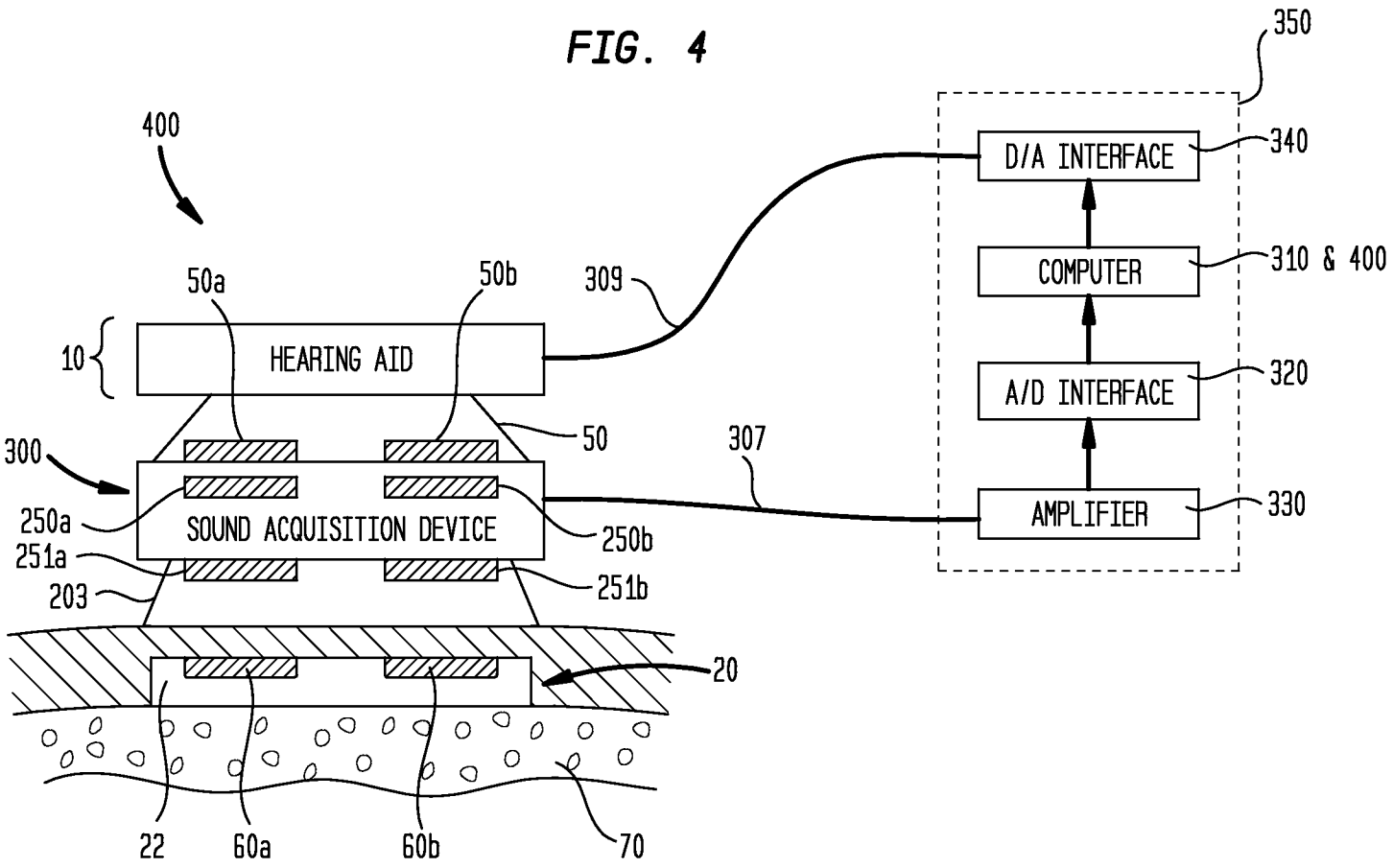
FIG. 4 shows one embodiment of a sound acquisition, processing and analyzing system 400.

FIG. 4 shows a cross-sectional view of one embodiment of sound acquisition device 300 operably coupled to hearing aid 10 and disposed thereabove, and magnetic implant 20 disposed beneath patient's skin 75 and attached to patient's skull 70 therebelow, where sound acquisition device 300, magnetic implant 20, hearing aid 10 (which includes magnetic spacer 50), and processing and analyzing means 350 together comprise sound acquisition, processing and analyzing system 400.

Continuing to refer to FIG. 4, and in one embodiment, hearing aid 10, sound acquisition device 300, and magnetic implant 20 together comprise portions of sound acquisition, processing and analyzing system 400. Electromagnetic ("EM") transducer 25 is disposed in housing 107 of hearing aid 10, and magnetic spacer 50 is operably coupled to EM transducer 25 and comprises magnetic members 50*a* and 50*b*, or any other suitable configuration of magnets (as for example discussed above or in the above-referenced the '057 and '934 patent applications). As described above, housing 107 and magnetic spacer 50 form external portions of magnetic hearing aid 10.

In the embodiment of system 400 shown in FIG. 4, magnetic implant 20 is configured for placement beneath patient's skin 75 and adjacent to or in a patient's skull 70. Magnetic implant 20 comprises magnetic members 60*a* and 60*b*, or any other suitable configuration of magnets (as for example discussed above or in the above-referenced the '057 and '934 patent applications). Magnetic spacer 50 and magnetic implant 20 are together configured such that magnetic members 50*a*, 50*b*, 60*a* and 60*b* are capable of holding magnetic hearing aid 10 in position on patient's skull 70 over at least portions of implanted magnetic implant 20.

System 400 of FIG. 4 further comprises sound acquisition device 300 configured to be positioned between magnetic spacer 50 and magnetic implant 20, and to be magnetically coupled both to magnetic spacer 50 and to magnetic implant 20 via magnetic members 250*a*, 250*b*, 251*a* and 251*b*. Sounds generated by EM transducer 25 in hearing aid 10 are acquired using sound sensor 257 forming a portion of sound acquisition device 300 (see, e.g., sound sensor 257 in FIGS. 5 and 7) as the sounds pass through sound acquisition device 300 into patient's skull 70.

Figure 5:
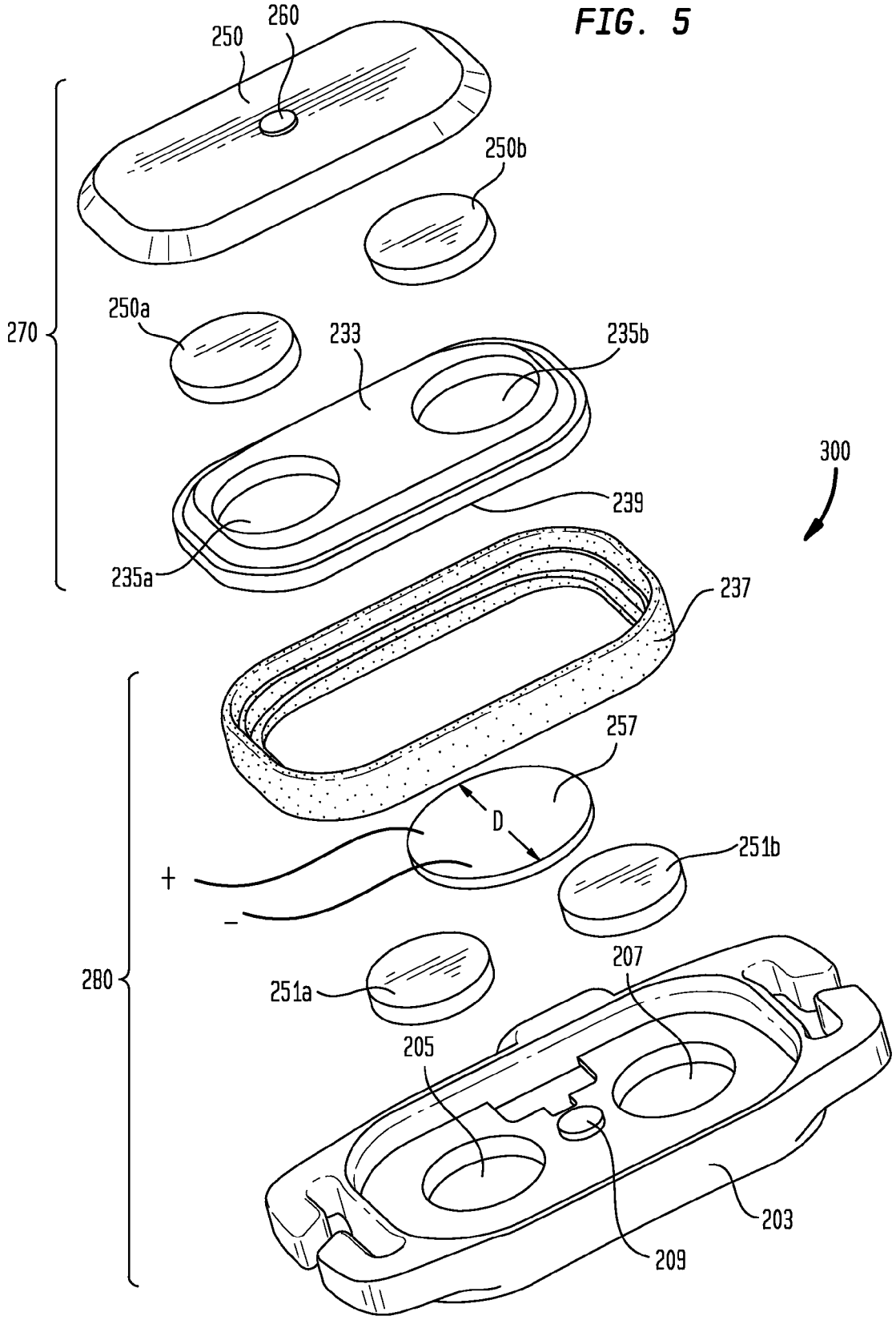
FIG. 5 shows an exploded top perspective view according to of one embodiment of sound acquisition device 300.
Figure 6C:
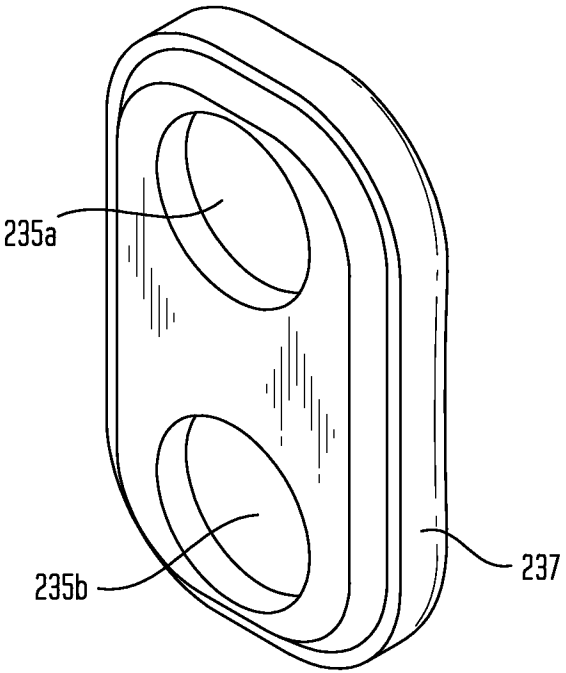
FIGS. 6(*a*), 6(*b*), 6(*c*) and 6(*d*) show various views of one embodiment of magnetic holder 233.
Figure 6B:
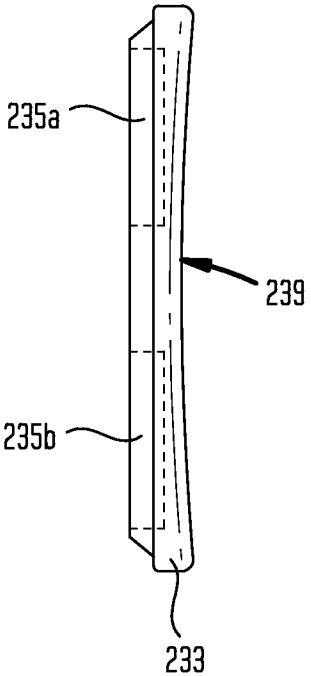
Figure 6A:
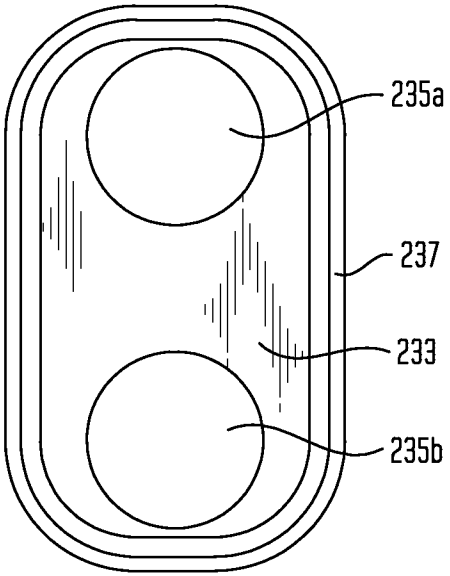
Figure 6D:
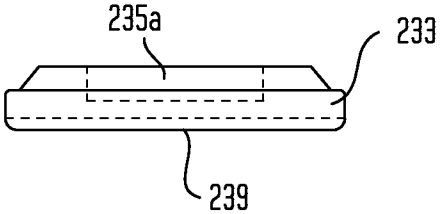

Referring now to FIG. 5, there is shown an exploded top perspective view according to of one embodiment of sound acquisition device 300. As shown in the FIG. 5, sound acquisition device 300 comprises top plate 250, magnetic holder 233, surrounding seal 237, and bottom plate 203. Top plate 250 and post 260 are configured to fit matingly below and against bottom corresponding portions of overlying magnetic spacer 50. Top plate 250, magnetic holder 233, and magnetic members 250*a* and 250*b* together comprise upper portion 270 of sound acquisition device 300. Top plate 250 may be incorporated into or onto magnetic holder 233 such that magnetic holder 233, magnetic members 250*a* and 250*b*, and top plate 250 form a single integral, molded or glued-together module.

In FIG. 5, magnetic members 250*a* and 250*b* are configured to be disposed within corresponding recesses 235*a* and 235*b* of magnetic holder 233. Many different numbers, variations, combinations and configurations of magnetic members 250 may be employed in sound acquisition device 300, as described above, and as those skilled in the art will appreciate after having read and understood the present specification. Magnetic members 251*a* and 251*b* are configured to be disposed in recesses 205 and 207 of bottom plate 203.

According to one embodiment, and as shown in FIG. 5, seal 237 is disposed between the upper and lower portions of sound acquisition device 300, where upper portion 270 of sound acquisition device 300 is attached to top portions of seal 237, and lower portion 280 of sound acquisition device 300 is attached to bottom portions of seal 237. Such attachments to surrounding seal 237 may be made by any one of suitable mechanical attachments means known to those skilled in the art, such as by using a suitable adhesive, silicone, screws, nuts and bolts, or the like. In some embodiments, seal 237 is formed of a pliable, compressible, resilient material such as silicone, rubber, an elastomer or similar material, and forms a seal protecting interior portions of sound acquisition device 300 from the ingress of ambient humidity, oils, water, chemicals, and so on. In one embodiment, and as shown in FIG. 5, bottom plate 203, sound sensor 257, magnetic members 251*a* and 251*b*, and seal 237 together comprise lower portion 280 of sound acquisition device 300.

In one embodiment, magnetic spacer 50 and sound acquisition device 300 are together configured to be magnetically coupled to one another via magnetic members 50*a* and 50*b* and corresponding magnetic members 250*a*, 250*b*, 250*c* and 250*d*, and magnetic implant 20 and sound acquisition device 300 are together configured to be magnetically coupled to one another via magnetic members 251*a* and 251*b* and corresponding magnetic members 60*a* and 60*b*.

In one embodiment, magnetic members 250*a* and 250*b* and magnetic members 251*a* and 251*b* of sound acquisition device 300 have suitable magnetic strengths and magnetic pole arrangements and positioning such that magnetic holder 233 may be magnetically coupled to and held in an operable position with respect to underlying bottom plate 203. In still further embodiments, magnetic members 250*a* and 250*b* and magnetic members 251*a* and 251*b* of sound acquisition device 300 are not configured to magnetically couple to one another, and upper and lower portions 270 and 280 are mechanically held together by adhesives, screws, bolts and nuts, or the like.

Continuing to refer to FIG. 5, there is also shown sound sensor 257, which is configured to be disposed atop central post or support 209, and sandwiched between central post or support 209 and underside 239 of magnetic holder 233 in an operable position, more about which is said below. In one embodiment, sound sensor 257 is glued to central post or support 209. According to some embodiments, sound sensor 257 is a piezoelectric sensor configured to convert sounds incident thereon and passing therethrough into corresponding electrical output signals. Other types of sound sensors may also be employed in sound acquisition device 300, as those skilled in the art will appreciate after having read and understood the present specification, such as membranes, diaphragms, accelerometers, velocity sensors, electromagnetic spring, coil and magnet sensors, and so on. Positive and negative connections are shown schematically in FIG. 5 as being attached to piezoelectric sensor 257, where such connections are used to route output signals from sensor 257 to an external device such as a processing and analyzing means 350 capable of receiving, processing, storing and/or analyzing the received output signals.

Referring now to FIGS. 6(*a*), 6(*b*), 6(*c*) and 6(*d*), there are shown top, side, side perspective, and end views according to one embodiment of magnetic holder 233. As particularly shown in FIG. 6(*b*), magnetic holder 233 comprises a curved acoustic sensor bending surface 239, which is configured and shaped to bend a first or top surface of piezoelectric sensor 257 along a curved surface defined by acoustic sensor bending surface 239 when sensor 257 is positioned operably between surface 239 and post 209, with its second or bottom surface engaging central support or post 209. The resulting bent or curved configuration of piezoelectric sensor 257 along curved surface 239 results in significantly enhanced and heightened sensitivity of piezoelectric sensor 257 to sounds being incident thereon and passing therethrough. Such enhanced and heightened sensitivity and increased response to incident sound waves results at least partially because piezoelectric sensor 257 is positioned and held in a pre-stressed state by curved surface 239. In one embodiment, curved acoustic surface 239 has a radius ranging between about 6 inches and about 8 inches. Other radii are contemplated, however, where the particular radius selected depends on factors such on the diameter D of piezoelectric sensor (see FIG. 7), the performance characteristics of the piezoelectric sensor that is to be selected, and the thickness t of the piezoelectric sensor (see FIG. 7).

Figure 7:
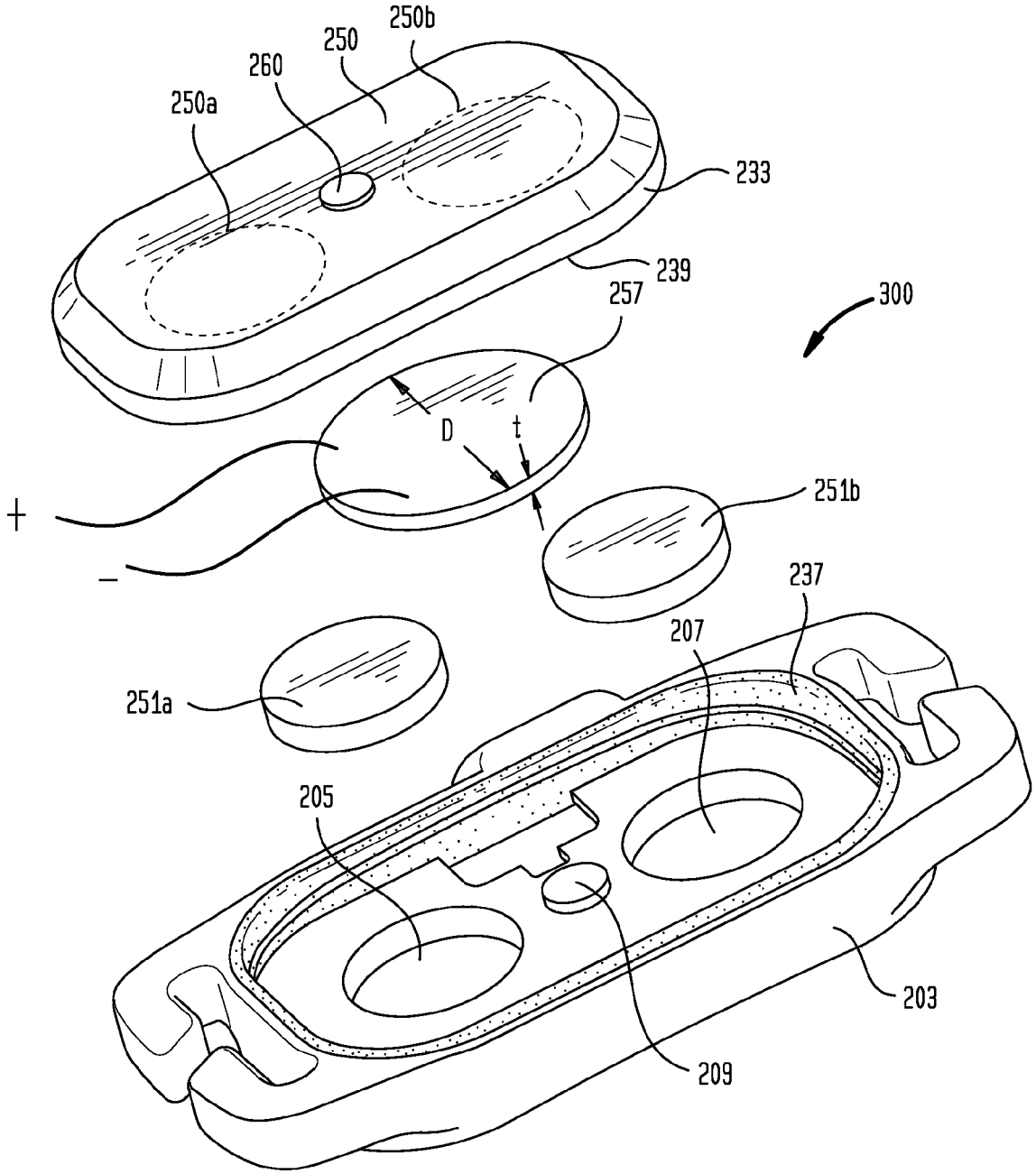
FIG. 7 shows a partially assembled top perspective view of sound acquisition device 300.

In one embodiment, and as shown in FIGS. 5 and 7, piezoelectric sensor 257 is disk-shaped or circular-shaped and has a diameter ranging between about 0.4 inches and about 1 inch In other embodiments, piezoelectric sensor 257 has an elliptical, rectangular, square or other shape. According to some embodiments, piezoelectric sensor 257 has a thickness ranging between about 0.2 mm and about 0.8 mm. One example of a suitable piezoelectric sensor 257 is an RoHS-compliant piezoelectric sensor manufactured by International Components Corporation of Bohemia, New York, U.S.A. having Part No. BPE20B-6.5.

FIG. 7 shows a partially assembled top perspective view of sound acquisition device 300. Top plate 250 has been joined with and mated to underlying magnetic holder 233, and magnet members 250*a* and 250*c* have been inserted within magnetic holder 233, to form upper portion 270 of sound acquisition device 300. Piezoelectric sensor 257, and magnetic members 251*a* and 251*b* remain yet to be inserted in bottom plate 203, while seal 237 has been attached to bottom plate 203. Seal 237, magnetic members 251*a* and 251*b*, piezoelectric sensor 257, and bottom plate 203 together comprise lower portion 280 of sound acquisition device 300.

Figure 8:
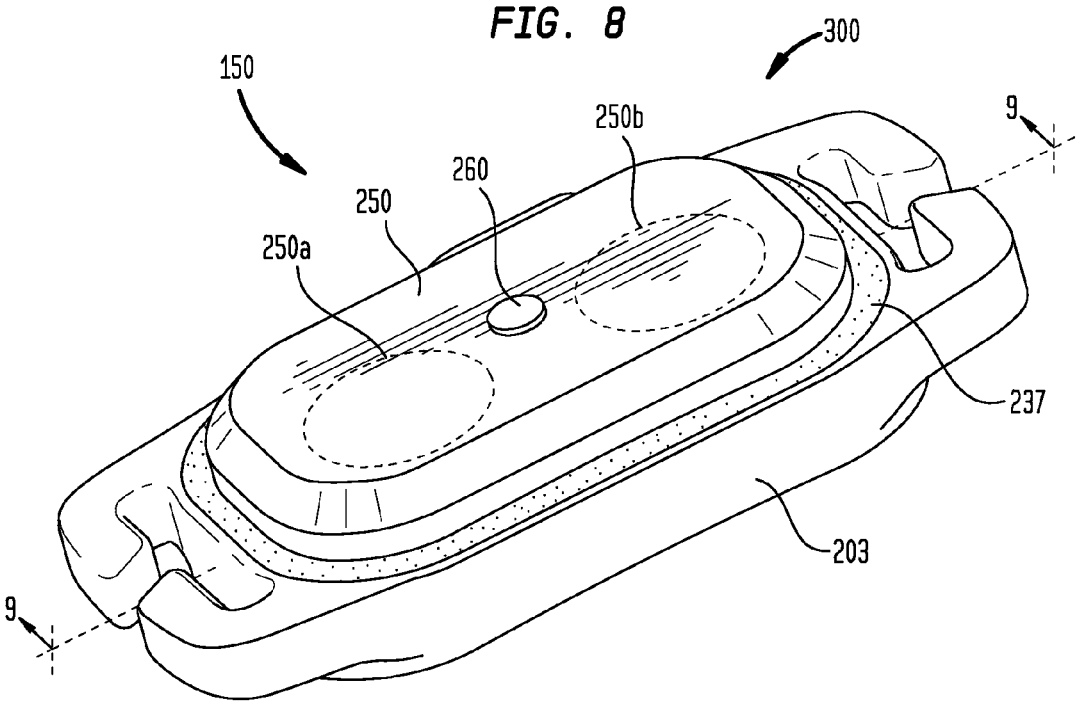
FIG. 8 shows one embodiment of sound acquisition device 300 in a fully assembled form.

FIG. 8 shows one embodiment of sound acquisition device 300 in a fully assembled form, where upper and lower portions 270 and 280 have been joined together to form a single device. Unit, module or device 300 may then be positioned between hearing 10 and magnetic implant 20, and provides direct measurements of the sounds transmitted by hearing aid 10 into the patient's skull 70.

Figure 9:
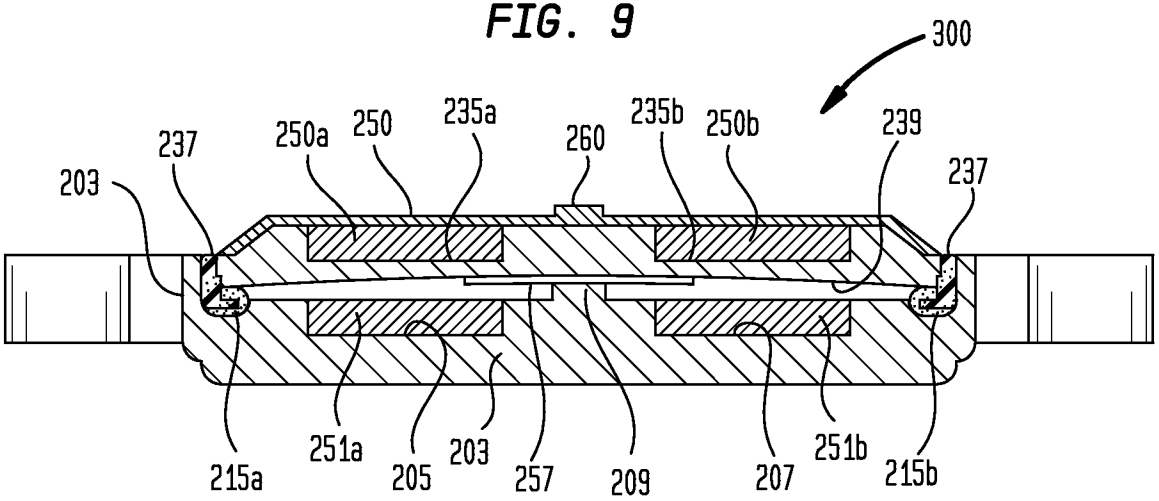
FIG. 9 shows a cross-sectional view of sound acquisition device 300 of FIG. 8.

Referring now to FIGS. 5, 7 and 8, seal 237 and upper and lower portions 270 and 280 of sound acquisition device 300 may also be configured so that upper portion 270 may be removed by a user from lower portion 280 and so that sound sensor 257 disposed therewithin may be adjusted or replaced with a sound sensor having different operating and physical characteristics (e.g., higher or lower sensitivity, greater or lesser diameter D, or greater or lesser thickness t—See FIG. 7). FIG. 9 shows a cross-sectional view of fully-assembled sound acquisition device 300 of FIG. 8. As shown, adhesive or silicone 215*a* and 215*b*, or any other suitable mechanical attachment means, connects seal 257 to top portion 270 and to bottom portion 280.

Figure 10:
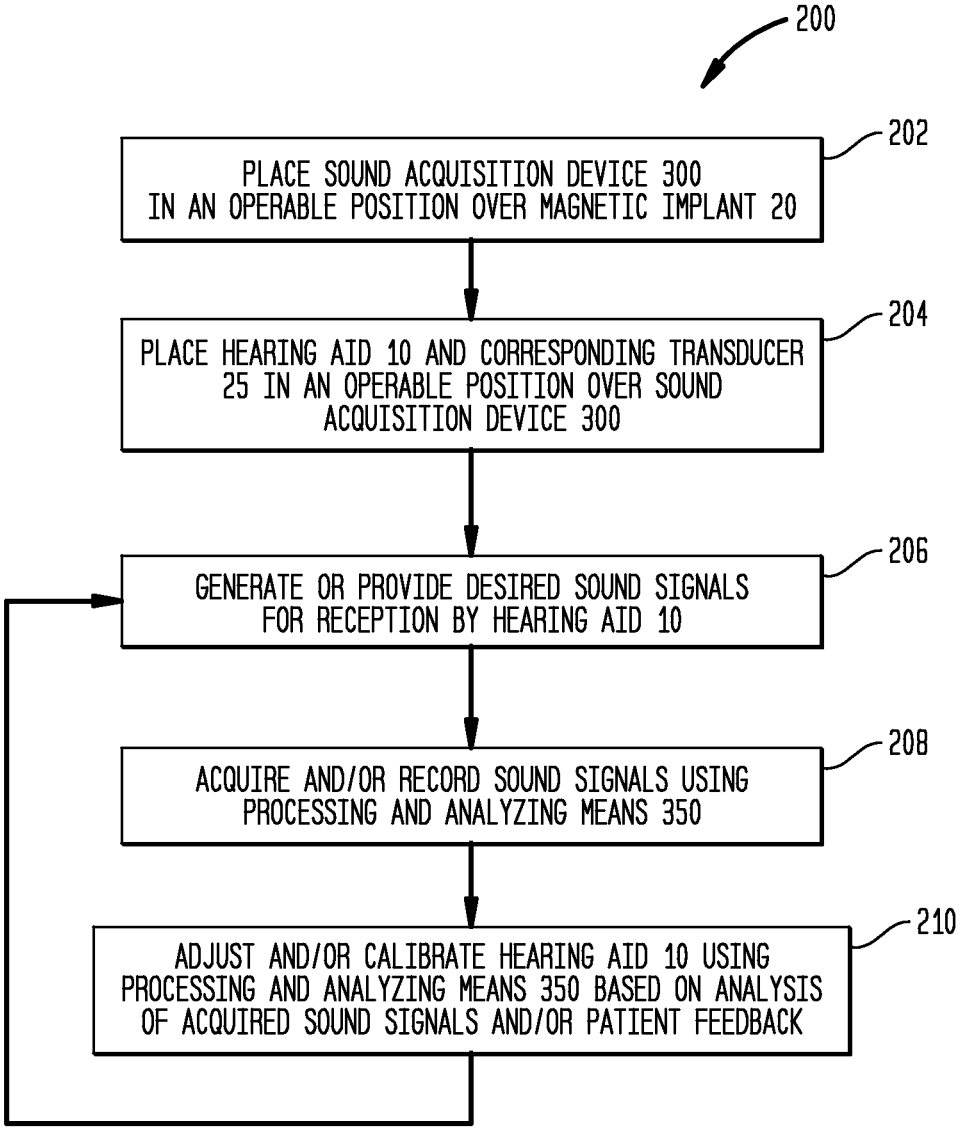
FIG. 10 shows one embodiment of a method 200 for acquiring sound or acoustic signals associated with hearing aid 10, processing and analyzing such signals, and then adjusting or calibrating hearing aid 10.

Referring now to FIGS. 4 and 10, one embodiment of sound acquisition, processing and analyzing system 400 comprises hearing aid 10 (which includes magnetic spacer 50), sound acquisition device 300, magnetic implant 20, where hearing aid 10, sound acquisition device 300, and magnetic implant 20 are all operably and magnetically coupled to one another, as well as to the patient's skull 70, and sound processing and analyzing system 350. Sounds or acoustic signals generated by piezoelectric sensor 257 in sound acquisition device 300 while transducer 25 of hearing aid 10 is generating output signals to be heard by a patient are transferred via connection 307 to amplifier 330, ND interface 320, and computer 310. (Note that any one or more of amplifier 330, A/D interface 320, and D/A interface 340 shown in FIG. 4 may be included in or form a portion of computer 310.) Electrical signals generated by sensor 257 in response to sounds generated by transducer 25 being incident thereon or passing therethrough are sent to system 350 for processing and analysis. Such transfer may be accomplished using hardwiring, or by wireless means, including but not limited to, Bluetooth means. In a wireless embodiment, sound acquisition device can be configured to include, for example, Bluetooth transmitters and/or receivers. Amplifier 330 in system 350 may or may not be required, depending on the amplitude of the output signals provided by sensor 257. Amplifier 330 may also be included in or form a portion of sound acquisition device 300.

Once data corresponding to sounds acquired by sound acquisition device 300 have been stored in a memory or other storage device of computer 310, such data may be processed and analyzed in computer 310 to yield various types of information regarding the acquired sound signals, such as their frequency, amplitude and phase characteristics using, for example, well known FFT and other digital signal processing techniques applied to the acquired acoustic signals. Spectral and other characteristics of the processed sound signals can be employed to determine, by way of non-limiting example, whether hearing aid 10 is coupled sufficiently or insufficiently to patient's skull 70, whether sound signals generated by hearing aid 10 have sufficient amplitude to be heard by the patient, or whether ambient acoustic noise should or should be reduced using a notch or other type of filter. Many other problems with hearing aid 10, magnetic implant 20, and/or the patient can thus be discovered and diagnosed through the use of sound acquisition device 300 and data processing and analyzing system 350.

As further shown in FIG. 4, computer 310 may also be operably connected to hearing aid 10 through D/A interface 340, and may be programmed and configured to generate electrical signals to drive EM transducer 25 in hearing aid 10 in accordance with desired operating parameters. Computer 310 may further be operably connected to hearing aid 10 through programming port 125 (see, e.g., FIG. 2(*a*) to program or re-program hearing aid 10 in accordance with the results of analysis of sounds acquired using sound acquisition device 300. Connection 309 between D/A interface 340 and hearing aid 10, and/or between computer 310 and hearing aid 10, may be provided by hard-wiring, or by wireless means, including but not limited to Bluetooth means. In one embodiment, connection 309 may be established with hearing aid 109 via programming port 125 or another suitable port on hearing aid 10. Processing and analyzing system 350 and/or computer 310 may thus be programmed to provide means for adjusting the output or response of hearing aid 10 and EM transducer. Such output or response adjustment of hearing aid 10 may include one or more of adjusting or calibrating the amplitude, frequency, or phase response of hearing aid 10 to ambient acoustic signals detected thereby, and/or to adjust the amplitude, frequency, or phase transfer functions of EM transducer 25.

In addition, processing and analyzing system 350 and/or computer 310 may further comprise one or more of a mobile electronic device, a mobile phone, a laptop computer, a desktop computer, and a notebook computer. In one embodiment, a mobile electronic device or mobile phone is operably connected or connectable to processing and analyzing system 350 and/or computer 310 and is configured to display information regarding at least one of the output, response, calibration and adjustment of the hearing aid. Thus, a mobile electronic device or mobile smartphone can be employed by a patient or a health care provider to monitor the performance of hearing aid 10.

Moreover, sounds or acoustic signals acquired using sound acquisition device 300 may be processed and analyzed using a mobile electronic device, a mobile phone, a laptop computer, a desktop computer, a notebook computer, a local server, a remote server, or the cloud. Results obtained by processing and analyzing the acquired sounds or acoustic signals may be visually displayed in any of a number of ways known to those skilled in the art, such as by displaying the results on a computer monitor or display, the screen of a mobile electronic device, mobile phone or smartphone, a laptop computer, a desktop computer, or a notebook computer.

Electrical signals representative of sounds or acoustic signals acquired by sound acquisition device 300 may be transferred to computer 310 or other device while hearing aid 10 is magnetically coupled to sound acquisition device 300, and while sound acquisition device 300 is magnetically coupled to magnetic implant 20, where magnetic implant 20 is implanted in or on a patient's skull. Alternatively, such acquired signals from sound acquisition device 300 may be transferred to computer 310 or other device while hearing aid 10 is magnetically coupled to sound acquisition device 300, and sound acquisition device 300 is magnetically coupled to magnetic implant 20, where magnetic implant 20 is implanted in or on a test fixture so as to measure the performance of hearing aid 10 under calibrated and known magnetic and mechanical coupling and resonance conditions.

Depending on the results provided by the processed and analyzed sounds or acoustic signals, sound control or calibration signals may be generated in computer 310 and provided to magnetic hearing aid 10 such that EM transducer 25 is driven in accordance with the desired or predetermined sound control or calibration signals. Such predetermined sound control or calibration signals may be stored or generated in computer 310, or stored or generated in a mobile electronic device, a mobile phone, a laptop computer, a desktop computer, a notebook computer, a local server, a remote server, or the cloud, and then made available for use in calibrating or driving hearing aid 10. As mentioned above, a frequency response of hearing aid 10 and/or transfer functions of EM transducer 25 may be determined by computer 310 using the acquired sounds, as may amplitude and phase responses. In response to determining and analyzing such frequency, amplitude or phase responses of hearing aid 10 and/or transfer functions of EM transducer 25, computer 310 or other device (as described above) may be programmed to adjust or change any one or more of such responses, or may further be programmed to program or re-program parameters in hearing aid 10 in accordance with results provided by the analyzed sounds or acoustic signals.

FIG. 10 shows one embodiment of a method 200 for acquiring sound or acoustic signals using sound acquisition device 300 in conjunction with magnetic hearing aid 10, magnetic implant 20 (or a test magnetic implant fixture corresponding thereto), and processing and analysis system 350, analyzing such sounds in computer 310, and then adjusting or calibrating hearing aid 10 in accordance with the results of the analysis provided using processing and analysis system 350. At step 202, sound acquisition device 300 is placed in an operable position over magnetic implant 20. At step 204, hearing aid 10 and corresponding transducer 25 are placed in an operable position over sound acquisition device 300. At step 206, ambient sound signals are provided or permitted to be provided to hearing aid 10, or alternatively, predetermined drive signals are provided to transducer 25. At step 208, signals sensed by one or more sensors 257 disposed in or on sound acquisition device 300 are acquired, and then recorded and/or stored in computer 310. At step 210, hearing aid 10 is adjusted or calibrated on the basis of the results provided by processing and analyzing sound signals acquired using sound acquisition device 300 and/or on the basis of patient feedback. Steps 206 through 210 may be repeated as required or desirable. One or more of steps 202 through 210 may be carried out in an order different from that shown in FIG. 10. In method 200, some steps of FIG. 10 may not be carried out, and other steps not specified explicitly herein may be added, as those skilled in the art will understand and appreciate after having read and understood the present specification.

Any one or more of hearing aid 10, sound acquisition device 300, processing and analyzing system 350, computer 310, and the various other computing and/or mobile electronic devices described herein may include one or more computer memories. Such memories may be implemented internally or externally with respect to associated CPUs, controllers, microcontrollers, ASICS, or processors/microcontroller 400. The memories may include one or more of a read-only memory ("ROM"), a random access memory ("RAM"), an electrically erasable programmable read-only memory ("EEPROM"), a FLASH memory, a hard disk, an optical disk, or another suitable magnetic, optical, physical, or electronic memory device. In some embodiments, the memory may include a double data rate (DDR2) synchronous dynamic random access memory (SDRAM) for storing data relating to and captured during operation of sound acquisition device 300. In some embodiments, the memory may include a memory card slot for receiving an external memory card, for example a card slot that is configured to receive a secure digital (SD) multimedia card (MMC) or a MicroSD card. These card slots may be used to transfer data between sound acquisition device 300 and external devices. Of course, other types of data storage devices may be used in place of the data storage devices discussed herein.

The memories described above may be configured to store programming instructions (or software code) therein, which can be executed by an associated processor to perform certain tasks. For example, in some embodiments, a software application stored on computer 310 or in a mobile computing device may be stored in a memory, or at least partially stored in the memory. The associated processor is configured to execute the software application.

Other examples of software that may be stored in the above-described memories may include, but are not limited to, firmware, one or more applications, program data, one or more program modules, and other executable instructions. Again, the processor associated with the memory is configured to retrieve from the memory and execute, among other things, instructions related to the processing, control and analysis processes and methods described in the present disclosure.

Hearing aid 10, sound acquisition device 300, processing and analyzing system 350, and any of the computing devices described above may include one or more communications ports for wired communication. In various embodiments, these communications ports may include, but are not limited to, universal serial bus (USB) ports, microUSB ports, High Definition Multimedia Interface (HDMI) ports, FireWire ports, Joint Test Action Group (JTAG) ports, universal asynchronous receiver/transmitter (UART) ports, etc.

Although not specifically illustrated, hearing aid 10, sound acquisition device 300, processing and analyzing system 350, and any of the computing devices described above may also include input/output ("I/O") systems that include routines for transferring information between components within their associated processors and other components of system 400.

In some embodiments, and referring to FIG. 10, one or more of steps 202 through 210 are performed by a software application or program. The software application may be installed on computer 310, or on any of the computing devices described above that communicatively coupled to hearing aid 10 and/or sound acquisition device 300. In some embodiments, software applications may be offered for download and installation on a local device such as a mobile computing device.

In some embodiments, one or more of the steps 202-210 are performed by a mobile or other computing device communicatively coupled to hearing aid 10 and/or sound acquisition device 300. In other embodiments, one or more of the steps 202-210 are performed by computer 310 communicatively coupled to hearing aid 10 and/or sound acquisition device 300. In some embodiments, processing and analyzing system 350, computer 310, or a portable or other electronic device includes a first transceiver configured to perform the receiving of data under a first communications protocol, a processor configured to perform repackaging of the data, and a second transceiver configured to send data under a second communications protocol.

In accordance with various embodiments of the present disclosure, hearing aid 10, sound acquisition system 300, processing and analyzing system 350, computer 310 or any of the portable or other computing devices described herein such as a mobile communications device and/or a network server, may include a bus component or other communication mechanisms for communicating information, which interconnects subsystems and components, such as a processing component (e.g., a processor, micro-controller, digital signal processor (DSP), etc.), a system memory component (e.g., RAM), a static storage component (e.g., ROM), a disk drive component (e.g., magnetic or optical), a network interface component (e.g., modem or Ethernet card), a display component (e.g., cathode ray tube (CRT), liquid crystal display (LCD) or light emitting diode (LED) display), an input component (e.g., a keyboard, mouse or touch screen), a cursor control component (e.g., a mouse or trackball), and an image capture component (e.g., an analog or digital camera). In one implementation, a disk drive component may comprise a database having one or more disk drive components.

In accordance with various embodiments of the present disclosure, processing and analyzing system 350, computer 310, and any of the other computing devices described herein may be configured to perform specific operations by an associated processor executing one or more sequences of one or more instructions contained in a system memory component. Such instructions may be read into the system memory component from another computer readable medium, such as a static storage component or disk drive component. In other embodiments, hard-wired circuitry may be used in place of (or in combination with) software instructions to implement the present disclosure.

Logic may be encoded in a computer readable medium, which may refer to any medium that participates in providing instructions to a processor for execution. Such a medium may take many forms, including but not limited to, non-volatile media and volatile media. In one embodiment, the computer readable medium is non-transitory. In various implementations, non-volatile media includes optical or magnetic disks, such as a disk drive component and volatile media includes dynamic memory, such as a system memory component. In one aspect, data and information related to execution instructions may be transmitted to one or more of the computing means described herein via a transmission medium, such as in the form of acoustic or light waves, including those generated during radio wave and infrared data communications. In various implementations, transmission media may include coaxial cables, copper wire, and fiber optics, including wires that are employed in a bus.

Some common forms of computer readable media include, for example, floppy disks, flexible disks, hard disks, magnetic tapes, any other magnetic medium, CD-ROMs, any other optical medium, punch cards, paper tape, any other physical medium with patterns of holes, RAM, PROM, EPROM, FLASH-EPROM, any other memory chip or cartridge, carrier wave, or any other medium a computing means is adapted to read.

In various embodiments of the present disclosure, execution of instruction sequences to practice the present disclosure may be performed by the computing means described herein. In various other embodiments of the present disclosure, a plurality of computing means or computer systems coupled by one or more communication links (e.g., a communications network, such as a LAN, WLAN, PTSN, and/or various other wired or wireless network, including telecommunications, mobile, and cellular phone networks) may perform instruction sequences to practice the present disclosure in coordination with one another.

The various computing means described herein may be configured to transmit and receive messages, data, information and instructions, including one or more programs (i.e., application code) through one or more communication links and/or communication interfaces. The received program code may be executed by a processor as received and/or stored in disk drive or other memory component, or some other non-volatile storage component for execution.

Where applicable, various embodiments provided by the present disclosure may be implemented using hardware, software, or combinations of hardware and software. Also, where applicable, the various hardware components and/or software components set forth herein may be combined into composite components comprising software, hardware, and/or both without departing from the spirit of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components and vice-versa.

Software, in accordance with the present disclosure, such as computer program code and/or data, may be stored on one or more computer readable mediums. It is also contemplated that software identified herein may be implemented using one or more general purpose or specific purpose computers and/or computer systems, networked and/or otherwise. Where applicable, the ordering of various steps described herein may be changed, combined into composite steps, and/or separated into sub-steps to provide features described herein.

The foregoing has outlined features of several embodiments so that those skilled in the art may better understand the detailed description set forth herein. Those skilled in the art will now understand that many different permutations, combinations and variations of sound acquisition device 300, hearing aid 10, magnetic implant 20, processing and analyzing system 350, computer 310, and any of the various computing or portable electronic or communication devices disclosed herein fall within the scope of the various embodiments. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

For example, wireless transmitting and/or receiving means may be attached to or form a portion of sound acquisition device 300, and such wireless means may be implemented using Wi-Fi, Bluetooth, or cellular means. Sensor 257 may be incorporated into hearing aid 10. Hearing aid 10 and/or sound acquisition device 300 may be configured to serve as a device that records and stores sound or acoustic signals detected by sensor 257 while hearing aid 10 is being worn by a patient. Such signals may be recorded and stored according to a predetermined schedule or continuously, and may be recorded and stored over brief periods of time (e.g., minutes) or over long periods of time (e.g., hours, days, weeks or months). Such stored signals may be retrieved and uploaded at a later point in time for subsequent analysis, and can, for example, be employed to determine optimal coupling, electronic, drive, sound reception or other parameters of hearing aid 10 and/or sound acquisition device 300. Sound acquisition device 300 may also be incorporated directly into hearing aid 10 to provide a test, evaluation or trial hearing aid 10. Accelerometers or other devices may be included in hearing aid 10 and/or sound acquisition device 300 so that posture, positions and changes in position of hearing aid 10 may be detected and stored. Moreover, the above-described embodiments should be considered as examples, rather than as limiting the scopes thereof.

After having read and understood the present specification, those skilled in the art will now understand and appreciate that the various embodiments described herein provide solutions to long-standing problems in the use of hearing aids, such as an inability to monitor or determine what a patient is actually hearing, or what the characteristics of the sound signals being generated by a hearing aid actually are.

We claim:

1. A sound acquisition system for a magnetic hearing aid, comprising:

an electromagnetic ("EM") transducer disposed in a housing;

a magnetic spacer operably coupled to the EM transducer and comprising at least a first magnetic member, the EM transducer, the housing and the magnetic spacer forming external portions of the magnetic hearing aid;

a magnetic implant configured to be placed beneath a patient's skin and adjacent to or in a patient's skull, the magnetic implant comprising at least a second magnetic member, the magnetic spacer and magnetic implant together being configured such that the first and second magnetic members are capable of holding the magnetic hearing aid in position on the patient's skull over at least portions of the implanted magnetic implant, and a sound acquisition device configured to be positioned between the magnetic spacer and the magnetic implant, and to be magnetically coupled to the magnetic spacer and the magnetic implant, such that sound signals generated by the EM transducer in the hearing aid may be acquired by a sound sensor forming a portion of the sound acquisition device as the sound signals pass through the sound acquisition device into the patient's skull, the sound sensor comprising a piezoelectric sensor.

2. The sound acquisition system of claim 1, wherein the sound acquisition device further comprises at least third and fourth magnetic members, the at least third magnetic member being configured to couple magnetically to the magnetic spacer, the at least fourth magnetic member being configured to couple magnetically to the magnetic implant, the at least third and fourth magnetic members further being configured to magnetically couple to one another.

3. The sound acquisition system of claim 1, wherein the sound measurement device further comprises upper and lower portions, the upper portion comprising the at least third magnetic member, the lower portion comprising the at least fourth magnetic member.

4. The sound acquisition system of claim 3, wherein the acoustic sensor is operably positioned between the upper and lower portions of the sound measurement device.

5. The sound acquisition system of claim 4, wherein at least one of the upper and lower portions of the sound measurement device comprises a curved acoustic sensor bending surface configured to bend a first surface of the piezoelectric sensor along a curved surface defined by the acoustic sensor bending surface, and the other of the at least one upper and lower portions comprises at least one support or post configured to engage a second surface of the piezoelectric sensor and hold the piezoelectric sensor in position against the curved sensor bending surface, the second surface opposing the first surface.

6. The sound acquisition system of claim 5, wherein the curved acoustic sensor bending surface has a radius ranging between 6 inches and 8 inches.

7. The sound acquisition system of claim 4, wherein the piezoelectric sensor is disk-shaped and has a diameter ranging between 0.4 inches and 1 inch.

8. The sound acquisition system of claim 4, wherein the piezoelectric sensor has a thickness ranging between 0.2 mm and 0.8 mm.

9. The sound acquisition system of claim 1, wherein the system further comprises a computer or analyzing circuitry operably connected to the sound acquisition device and configured to receive and process signals generated by the acoustic sensor.

10. The sound acquisition system of claim 9, wherein the computer or analyzing circuitry is further configured to generate electrical signals to drive the EM transducer in the hearing aid.

11. The sound acquisition system of claim 10, wherein the drive signals generated by the computer or analyzing circuitry are provided to the hearing aid and the EM transducer by one of: (a) wireless signals; and (b) a computer or signal cable operably connected to the computer or analyzing circuitry.

12. The sound acquisition system of claim 9, wherein the computer or analyzing circuitry is further configured to adiust the output or response of the hearing aid and the EM transducer.

13. The sound acquisition system of claim 12, wherein the output or response adjustment includes at least one of adjusting or calibrating the an amplitude, a frequency, and a phase response of the hearing aid to ambient acoustic signals detected thereby.

14. The sound acquisition system of claim 9, wherein the computer or analyzing circuitry further comprises one of a mobile electronic device, a mobile phone, a laptop computer, a desktop computer, and a notebook computer.

15. The sound acquisition system of claim 9, wherein the system further comprises a mobile electronic device or mobile phone operably connected or connectable to the computer or analyzing circuitry and configured to display information regarding at least one of the output, response, calibration and adjustment of the hearing aid.

16. A sound acquisition device configured to be used in a sound measurement system for a magnetic hearing aid, the system comprising an electromagnetic ("EM") transducer disposed in a housing, a magnetic spacer operably coupled to the EM transducer and comprising at least a first magnetic member, the EM transducer, the housing and the magnetic spacer forming external portions of the magnetic hearing aid, and a magnetic implant configured to be placed beneath a patient's skin and adjacent to or in a patient's skull, the magnetic implant comprising at least a second magnetic member, the magnetic spacer and magnetic implant together being configured such that the first and second magnetic members are capable of holding the magnetic hearing aid in position on the patient's skull over at least portions of the implanted magnetic implant, the sound acquisition device being configured to be positioned between the magnetic spacer and the magnetic implant, and to be magnetically coupled to the magnetic spacer and the magnetic implant, such that sound signals generated by the EM transducer in the hearing aid may be acquired by a sound sensor forming a portion of the sound acquisition device as the sound signals pass through the sound acquisition device into the patient's skull, the sound sensor comprising a piezoelectric sensor.

17. The sound acquisition device of claim 16, wherein the sound acquisition device further comprises at least third and fourth magnetic members, the at least third magnetic member being configured to couple magnetically to the magnetic implant, the at least fourth magnetic member being configured to couple magnetically to the magnetic spacer, the at least third and fourth magnetic members further being configured to magnetically couple to one another.

18. The sound acquisition device of claim 16, wherein the sound acquisition device further comprises upper and lower portions, the upper portion comprising the at least third magnetic member, the lower portion comprising the at least fourth magnetic member.

19. The sound acquisition device of claim 18, wherein the acoustic sensor is operably positioned between the upper and lower portions of the sound acquisition device.

20. The sound acquisition device of claim 19, wherein at least one of the upper and lower portions of the sound acquisition device comprises a curved acoustic sensor bending surface configured to bend a first surface of the piezoelectric sensor along a curved surface defined by the acoustic sensor bending surface, and the other of the at least one upper and lower portions comprises at least one support or post configured to engage a second surface of the piezoelectric sensor and hold the piezoelectric sensor in position against the curved sensor bending surface, the second surface opposing the first surface.

21. The sound acquisition device of claim 18, wherein the curved acoustic sensor bending surface has a radius ranging between 6 inches and 8 inches.

22. The sound acquisition device of claim 19, wherein the piezoelectric sensor is disk-shaped and has a diameter ranging between 0.4 inches and 1 inch.

23. The sound acquisition device of claim 19, wherein the piezoelectric sensor has a thickness ranging between 0.2 mm and 0.8 mm.

24. The sound acquisition device of claim 16, wherein the system further comprises a computer operably connected to the sound acquisition device and configured to receive and process signals generated by the acoustic sensor.

25. A method of acquiring sound signals generated by an external magnetic hearing aid configured to be coupled to a magnetic implant, the magnetic hearing aid comprising an electromagnetic ("EM") transducer disposed in a housing and a magnetic spacer operably coupled to the EM transducer and comprising at least a first magnetic member, the magnetic implant being configured to be placed beneath a patient's skin and adjacent to or in the patient's skull, the magnetic implant comprising at least a second magnetic member, the magnetic spacer and magnetic implant together being configured such that the first and second magnetic members are capable of holding the magnetic hearing aid in position on the patient's skull over at least portions of the magnetic implant when the magnetic implant is implanted in the patient and the magnetic hearing aid is placed thereover, the sound acquisition device being configured to be positioned between the magnetic spacer and the magnetic implant, and to be magnetically coupled to the magnetic spacer and the magnetic implant, such that sound signals generated by the EM transducer in the hearing aid may be acquired by a sound sensor forming a portion of the sound acquisition device as the sound signals pass through the sound acquisition device into the patient's skull, the sound sensor comprising a piezoelectric sensor, the method comprising:

(a) acquiring the sound signals sensed by the sound sensor;

(b) processing the acquired sound signals, and (c) analyzing the sound signals.

26. The method of claim 25, further comprising analyzing the sound signals using one of a mobile electronic device, a mobile phone, a laptop computer, a desktop computer, a notebook computer, a local server, and a remote server.

27. The method of claim 25, further comprising amplifying the acquired sound signals.

28. The method of claim 25, further comprising visually displaying results corresponding to the analyzed or processed sound signals.

29. The method of claim 28, further comprising visually displaying the results on one of a computer monitor or display, a mobile electronic device, a mobile phone, a laptop computer, a desktop computer, and a notebook computer.

30. The method of claim 25, further comprising generating sound control or calibration signals and providing such sound control or calibration signals to the magnetic hearing aid such that the EM transducer is driven in accordance with the sound control or calibration signals.

31. The method of claim 30, wherein the sound control or calibration signals are predetermined and stored in a mobile electronic device, a mobile phone, a laptop computer, a desktop computer, a notebook computer, a local server, and a remote server.

32. The method of claimer 27, wherein analyzing the amplified sound signals further comprises at least one of determining a frequency response of the hearing aid, determining an amplitude response of the hearing aid, and determining a phase response of the hearing aid.

33. The method of claim 32, further comprising adjusting or changing at least one of a frequency response, an amplitude response, and a phase response of the hearing aid in accordance with results provided by the analyzed sound signals.

34. The method of claim 25, further comprising acquiring the sound signals while the hearing aid is magnetically coupled to the sound acquisition device, and the sound acquisition device is magnetically coupled to the magnetic implant, where the magnetic implant is implanted in or on the patient's skull.

35. The method of claim 25, further comprising acquiring the sound signals while the hearing aid is magnetically coupled to the sound acquisition device, and the sound acquisition device is magnetically coupled to the magnetic implant, where the magnetic implant is attached to a test fixture.

36. The method of claim 25, further comprising programming or re-programming parameters in the hearing aid in accordance with results provided by the analyzed sound signals.

37. The method of claim 25, further comprising wirelessly transmitting the acquired sound signals to a mobile electronic device, a mobile phone, a laptop computer, a desktop computer, a notebook computer, a local server, and a remote server.

* * * * *